US005819332A

United States Patent [19]

Perry

[11] Patent Number: 5,819,332

[45] Date of Patent: Oct. 13, 1998

[54] SPA/HOT TUB COVER REMOVAL APPARATUS AND METHOD

[76] Inventor: Gary L. Perry, 3325 W. Cedar Meadows La., Manhattan, Mont. 59741

[21] Appl. No.: 951,358

[22] Filed: Oct. 16, 1997

Related U.S. Application Data

[60] Provisional application No. 60/028,721, Oct. 17, 1996.

[51] Int. Cl.[6] ..... E04H 4/00

[52] U.S. Cl. ..... 4/498; 4/496

[58] Field of Search ..... 4/498, 494, 500, 4/496, 503, 546, 580; 220/263, 329, 731

[56] References Cited

U.S. PATENT DOCUMENTS

| | | |
|---|---|---|
| 4,853,985 | 8/1989 | Perry . |
| 4,857,374 | 8/1989 | Perry . |
| 4,991,238 | 2/1991 | Forrest . |
| 5,131,102 | 7/1992 | Salley et al. . |
| 5,471,685 | 12/1995 | Cross . |
| 5,517,703 | 5/1996 | Ouelette . |
| 5,584,081 | 12/1996 | Ouelette . |
| 5,634,218 | 6/1997 | Ouelette . |
| 5,644,803 | 7/1997 | Wilson . |
| 5,689,841 | 11/1997 | Black et al. ..... 4/498 |

*Primary Examiner*—David J. Walczak
*Attorney, Agent, or Firm*—William G. Forster

[57] ABSTRACT

A spa cover removal apparatus. The removal apparatus includes a pair of elongate spaced apart side arms. One end of each side arm is pivotally connected to the bottom side portion of a spa side, and the opposing end rotatingly engages a side edge of the spa cover. In this way, the spa cover can rotate in relation to the side arms such that a horizontal cover rotation axis is defined by the axis of rotation of the spa cover relative to the side arms. A back rack is pivotally coupled to the rear edge of the spa cover to enable the spa cover to pivot, relative to the back rack, about a horizontal cover pivot axis. In addition, a base bracket assembly is provided for pivotally connecting the back rack to the back surface of the spa. This enables the back rack to pivot, relative to the base bracket assembly, about a substantially horizontal back rack pivot axis. With this arrangement, a rearwardly directed force can be increasingly applied to the spa cover causing the same to lift and move rearward, above the spa, wherein the side arms pivot relative to the spa, and the back rack pivots relative to the base bracket assembly, responsive to rearward movement of the spa cover. As a result, the spa cover shifts from a first horizontal covering position over the spa, to a second stowed position adjacent the back surface of the spa.

20 Claims, 10 Drawing Sheets

24
26
28
30
33
46

98
87
85
OR
81
79
80
76
77
78
81
78

44
80
38

30
66
73
34
71
68
74

75
OR
70
72
73
66
64
68
34
74
71

SPA/HOT TUB COVER REMOVAL APPARATUS AND METHOD

This application claims the benefit of U.S. Provisional Application No. 60/028,721 filed Oct. 17, 1996.

BACKGROUND

Spa cover removal systems and mechanisms are known in the art. Such mechanisms vary widely in complexity, ease of operation and cost of manufacturing. In recent years, the rise in popularity of spas/ hot tubs has hastened the development of spa covers and removal apparatus therefor. One early design for cover removal is disclosed in U.S. Pat. No. 4,857,374 issued to Perry (Gary L.) in 1989. The Perry design employs gas springs that extend from the sides of a spa to a spa cover that is hinged to the rear of the spa. In this way, the gas springs assist the user to pivot the cover to a vertical position, away from the top of the spa.

U.S. Pat. No. 4,853,985 issued to Perry (Cliff R.) in 1989 shows a cover assembly for use with a spa. The cover assembly includes a cover member mounted for rotational movement to the spa structure by mounting arms. The mounting arms are arranged relative to the cover member so that the cover member travels along a path from a covering position to an open position. Additionally, the '985 device includes tension springs. Because of the arrangement of the mounting arms and their attachment to the spa cover, the design is not easily adaptable for use with spa covers that fold back to expose only a portion of the spa.

U.S. Pat. No. 4,991,238 issued to Forrest in 1991 shows a spa cover lift that includes one or more struts for positioning a movable frame adapted for pivotable attachment to the side of a spa. The lift includes apparatus for receiving a spa cover from the spa and retaining the cover adjacent the movable frame. The struts are operable to displace the movable frame to an extended position to provide a surface onto which a spa user can slide a spa cover. Because the Forrest device requires that the entire spa cover be moved rearward onto the movable frame, a single user could find it difficult to slide a large heavy cover.

U.S. Pat. No. 5,131,102 issued to Salley in 1992 shows a device for use in conjunction with a spa cover mounted for pivotal movement to facilitate the removal of the cover away from the vicinity of the spa or spa when the same is in use. A bridge arm supported by two side arms is pivotally attached to a base. The bridge arm can be pivoted into position adjacent the spa cover. With the spa cover folded over, the bridge arm is pivoted clearly away from the spa. The arrangement of the '102 device is such that it provides support to the spa cover only at the cover's folding point during the removal process. Accordingly, a portion of the cover slides over the spa as a user operates the device to remove the cover.

U.S. Pat. No. 5,471,685 issued to Cross in 1995 shows a support for a cover of a hot tub/ spa having a pair of roller support arms, each having a pivotal connection for securing it to the spa. The pivotal connections each comprise an attachment member for mounting on a vertical outer wall of the spa, with a hinge connecting the support arm to its attachment member for pivotation between operative and inoperative positions. Like the Forrest device, the entire spa cover must be moved rearward onto the frame.

U.S. Pat. No. 5,517,703 issued to Ouelette in 1996 shows a lifting mechanism for removing and restoring a hinged spa cover from a spa tub. Two tubular brackets are cojoined so that base members on the brackets are aligned parallel, adjacent to one end of the spa, and arms on the brackets extend along opposite sides of the spa. The cojoined base members are pivotally mounted so that the lifting arms are rotatable between a first lowered position and a second raised position. Support beams are connected to the lifting arms over which the hinged sections of the cover are foldable when the arms are in the first position allowing the cover to be lifted clear of the spa when the arms are moved to the second raised position. Like the Salley device, the '703 cover removal apparatus, during the removal process, provides support to the spa cover only at the cover's folding point.

U.S. Pat. No. 5,584,081 issued to Ouelette in 1996 shows a lifting frame for a hinged spa cover having a pair of adjustable lifting arms pivotally mounted adjacent the side walls of a spa. A U-shaped foot actuated lever is connected to the lifting arms with the base of the lever extended across one end wall of the spa. The upper part of the arms are equipped with one or more supports that are adjacent to and parallel with the cover hinge whereby the cover is foldable over the support or supports when the lifting arms are in a first position. The foot lever is elevated when the lifting arms are in the first position, and depressing the lever causes the arms to be rotated to a second position whereby the folded cover is supported in a vertical position adjacent one end wall of the spa. Like the earlier Ouelette invention, the spa cover is supported only at its folding point.

U.S. Pat. No. 5,634,218 issued to Ouelette in 1997 shows a lifting frame for a hinged spa cover having a pair of adjustable lifting arms pivotally mounted on or adjacent to a side wall of a spa. The upper part of the arms are equipped with one or more supports that are adjacent to and parallel with the cover hinge with the cover being foldable over the support or supports when the lifting arms are in a first horizontal position. Rotation of the frame causes the folded cover to be rotated to a second, vertical position adjacent one end wall of the spa. Similar to the other Ouelette devices, this design provides support to the spa cover only at its folding point.

U.S. Pat. No. 5,644,803 issued to Wilson in 1997 shows a spa support assembly that is provided with a plurality of support arms having upper and lower ends with the lower ends pivotally attached to an external surface of the spa side wall for pivotal rotation of the upper ends of the support arms through an arc from a point above and adjacent to the side wall to a point away from the side wall at a point where the upper ends of the support arms are within the generally horizontal plane defined by the top surfaces of the side walls and at a distance away from the side wall. Like the prior '238 and '685 patents, the Wilson device requires that the user slide the spa cover rearward over the spa during the removal process.

None of these earlier designs allow a user to easily remove a folded spa cover from a spa such that the entire spa cover is fully supported and shifted away from the spa without having the spa cover slide over or contact the top spa surfaces during the shifting procedure.

SUMMARY OF THE INVENTION

One object of the present invention is reduce the effort required to remove a spa cover from a spa.

A second object is to facilitate the removal of a spa cover from a spa by only one person.

Another object is to protect expensive spa covers by simplifying the removal process thereof from a spa.

Yet another object is to reduce the expense of heating water in spas by promoting the use of spa covers that are easily removed by one person.

A further object is to reduce wear on the top surfaces of a spa.

Still another object is to fully support a spa cover so that all portions thereof lift away from a spa during the cover removal process.

The invention is a spa cover removal apparatus for assisting the user in the repositioning and/or removal of a spa cover from a spa/hot tub. The removal apparatus includes a pair of elongate spaced apart side arms: each side arm being disposed adjacent a spa side of the spa. One end of each side arm is pivotally connected to the bottom side portion of a spa side, and the opposing end rotatingly engages a side edge of the spa cover. In this way the spa cover can rotate in relation to the side arms such that a horizontal cover rotation axis is defined by the axis of rotation of the spa cover relative to the side arms. The arrangement of each side arm being the mirror image of the other. A back rack is pivotally coupled to the rear edge of the spa cover to enable the spa cover to pivot, relative to the back rack, about a horizontal cover pivot axis. In addition, a base bracket assembly is provided for pivotally connecting the back rack to the back surface of the spa. This enables the back rack to pivot, relative to the base bracket assembly, about a substantially horizontal back rack pivot axis. With this arrangement, a rearwardly directed force can be increasingly applied to the spa cover causing the same to lift and move rearward, above the spa, wherein the side arms pivot relative to the spa, and the back rack pivots relative to the base bracket assembly, responsive to rearward movement of the spa cover. As a result, the spa cover shifts from a first horizontal covering position over the spa, to a second stowed position adjacent the back surface of the spa.

In another aspect of the invention as the spa cover initially shifts from the first horizontal covering position over the spa, to the second stowed position, the entire spa cover moves upward as well as rearward.

In another aspect of the invention the side arms are parallel and extend upward, in relation to horizontal, at an angle between 52 degrees and 56 degrees from the bottom side portion of a spa side to the side edge of the spa cover.

The foregoing and other objects, features, and advantages of this invention will become more readily apparent from the following detailed description of a preferred embodiment which proceeds with reference to the accompanying drawings.

BRIEF DESCRIPTION OF THE DRAWINGS

FIGS. 4A through 4E are simplified fragmentary side elevation views sequentially showing a spa cover being removed by a "cover cradle" spa cover removal apparatus provided in accordance with the present invention, wherein FIG. 4A represents the first horizontal "spa covering" position, of the spa cover, over the spa where the cover's weight is substantially supported by the spa 28, and FIG. 4E represents the second stowed position, of the spa cover, to the rear and downward relative to the back surface of the spa wherein the weight of the spa cover is supported substantially by the back rack of the cover cradle.

DETAILED DESCRIPTION OF PREFERRED EMBODIMENTS

Figure 1:
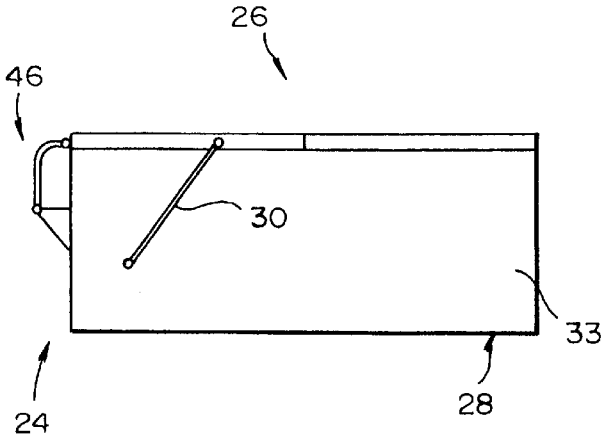
FIG. 1 is a simplified side elevation view showing a spa cover removal apparatus, referred to herein as a "cover cradle", the cover cradle being attached to a spa cover which is disposed over the spa to completely cover the same.
Figure 2:
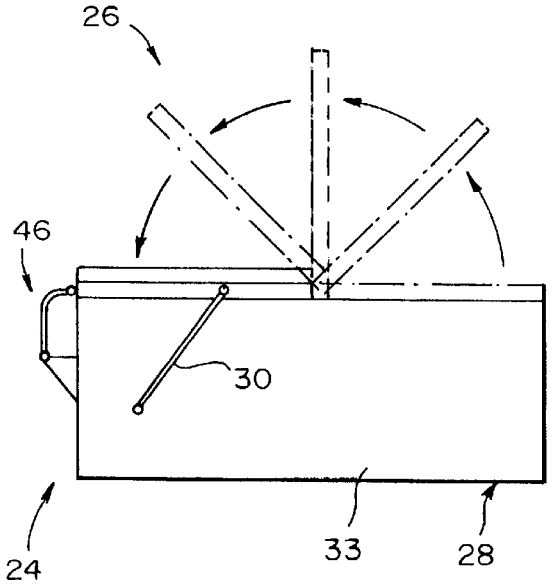
FIG. 2 is a simplified side elevation view of a spa cover being folded over, with phantom lines and arrows indicating direction of movement, in preparation for removal thereof from the spa.
Figure 3:
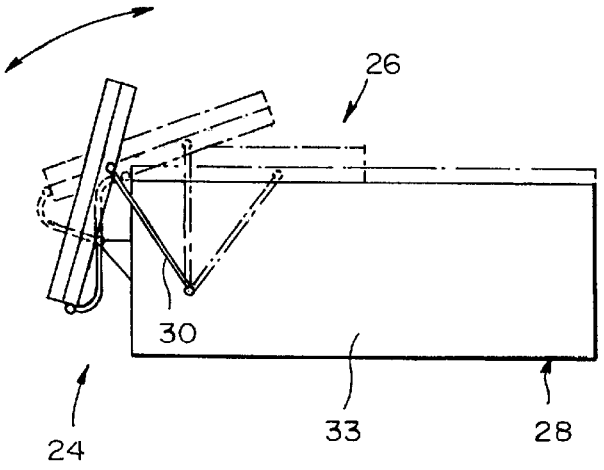
FIG. 3 is a simplified side elevation view showing the motion of a cover cradle removal apparatus at varying stages of removing a spa cover, with phantom lines denoting the spa cover's position prior to being fully removed from the spa.

FIGS. 1 through 9 show a spa/hot tub cover removal apparatus in accordance with the present invention. The spa cover removal apparatus is hereinafter referred to as a cover cradle 24. The cover cradle 24 is provided to assist in the removal and/or repositioning of a spa cover 26 from a spa/hot tub 28.

Primarily, the cover cradle 24 comprises a pair of elongate spaced apart parallel side arms 30 and 32, the side arms 30–32 being disposed on opposite sides, i.e., spa side 33 and spa side 35 of the spa 28. The side arms 30–32 are constructed substantially alike, typically from tubular aluminum, wherein the lower end 34 of side arm 30 is pivotally connected to the bottom side portion 36 of spa side 33. Further, the opposing upper end 38 rotatingly engages the side edge 40 of the spa cover 26. Importantly, it should be appreciated that the construction, arrangement and positioning of each side arm 30–32 is the mirror image of the other. In addition, a horizontal cover rotation axis 44 is defined by the connection of the side arms 30–32 to the spa cover 26.

To pivotally support the spa cover 26 at the rear thereof is a back rack 46 pivotally coupled to the rear edge 48 of the spa cover 26. In this way, the spa cover 26 is enabled to pivot about a horizontal cover pivot axis 50 which is defined by connection joint 52 disposed between the back rack 46 and the spa cover 26.

For pivotally connecting the back rack 46 to the back surface 54 of the spa 28, a pair of horizontally spaced base bracket assemblies 56–57 are provided. As will be discussed more fully below, each base bracket assembly is fastened to the back surface 54 by a plurality of ordinary threaded fasteners. Moreover, the back rack 46 is pivotally coupled to the base bracket assemblies 56–57 to enable the back rack 46 to pivot about a substantially horizontal back rack pivot axis 58.

With a cover cradle 24 constructed and disposed as noted above, the weight of the spa cover 26 is transferred to the cover cradle 24 as a rearwardly directed force is applied to the spa cover 26. For example, as a rearwardly directed force is applied to the spa cover 26, by pulling the rear handle 60 thereof, the back rack 46 pivots rearward about the back rack pivot axis 58 causing the spa cover 26 to rotate about the cover rotation axis 44. Accordingly, the cover rotation axis 44 translates substantially rearward. As a result, the spa cover 26 simultaneously pivots about the cover pivot axis 50, wherein the cover pivot axis 50 likewise translates rearward and also downward.

In this way, the spa cover 26 shifts from a first horizontal "spa covering" position over the spa 28 where the weight of the spa cover 26 is substantially supported by the spa 28, to a second stowed position to the rear and downward relative to the back surface 54 of the spa 28 wherein the weight of the spa cover 26 is supported substantially by the back rack 46 of the cover cradle 24. As will be discussed more fully below, a biasing member 62, such as a gas spring 63, is operatively disposed between each base bracket assembly 56–57 and the back rack 46. The biasing member 62 is adapted to provide increasing resistance against the pivoting action of the back rack 46 as the same pivots about the back rack pivot axis 58 to shift the spa cover 26 to the second stowed position.

Figure 6:
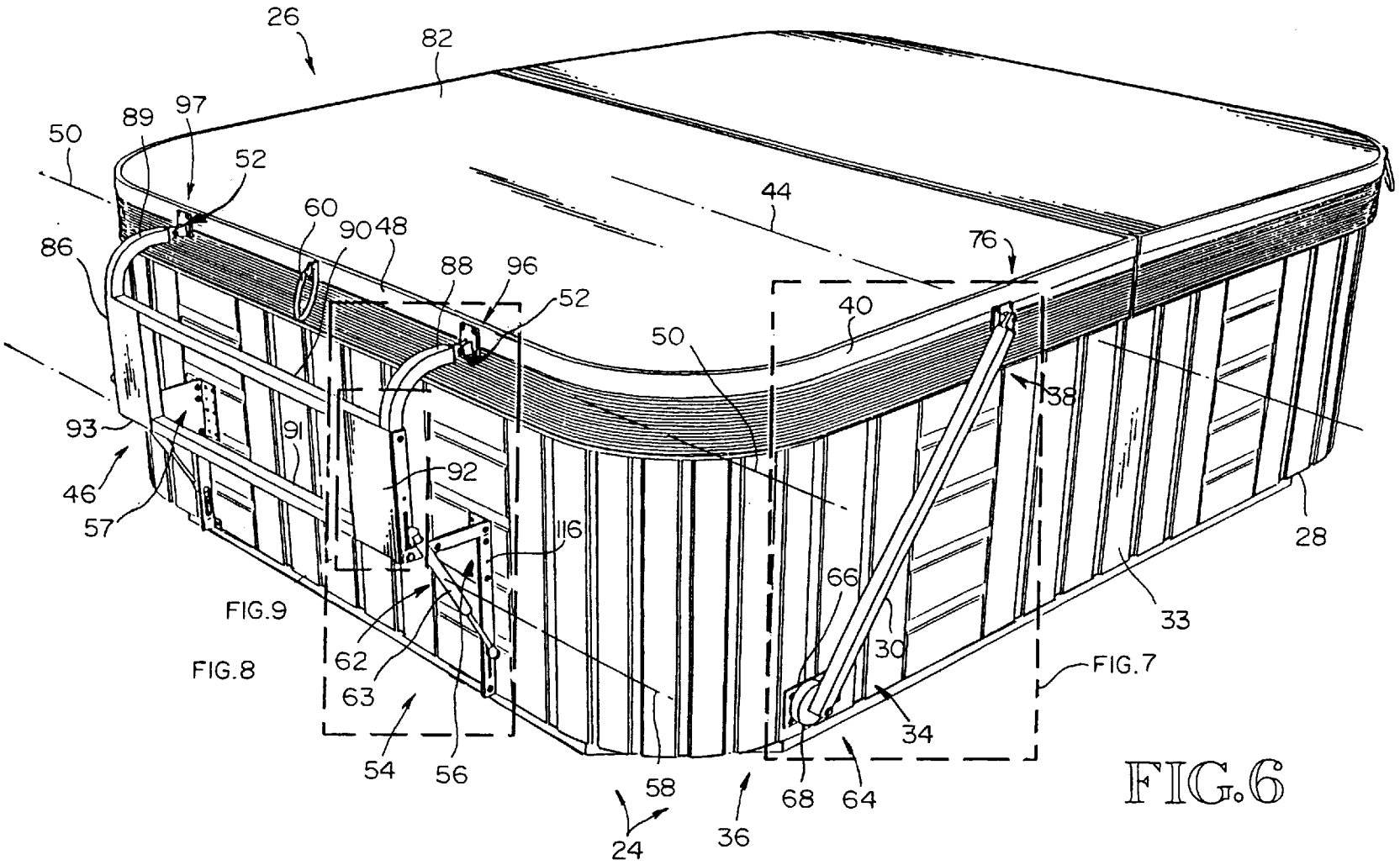
FIG. 6 is a rear perspective view, similar to FIG. 5, showing a cover cradle mounted to the back surface of a spa in accordance with the present invention, wherein encircled portions of the back rack and side arm represent matter that is illustrated and enlarged in additional FIGS. 7 through 9.

Considering now in more detail the structure of the components from which a cover cradle 24 is constructed, FIG. 6 illustrates a cover cradle 24 operatively connected to a spa 28, and to a spa cover 26 disposed thereover. As illustrated, a side arm 30 extends upward from the bottom side portion 36 of a spa 28 to the side edge 40 of the spa cover 26. It should be appreciated that in the preferred embodiment, the side arm 30 is substantially parallel to the side of the spa 28.

Figures 7, 7A, 7B:
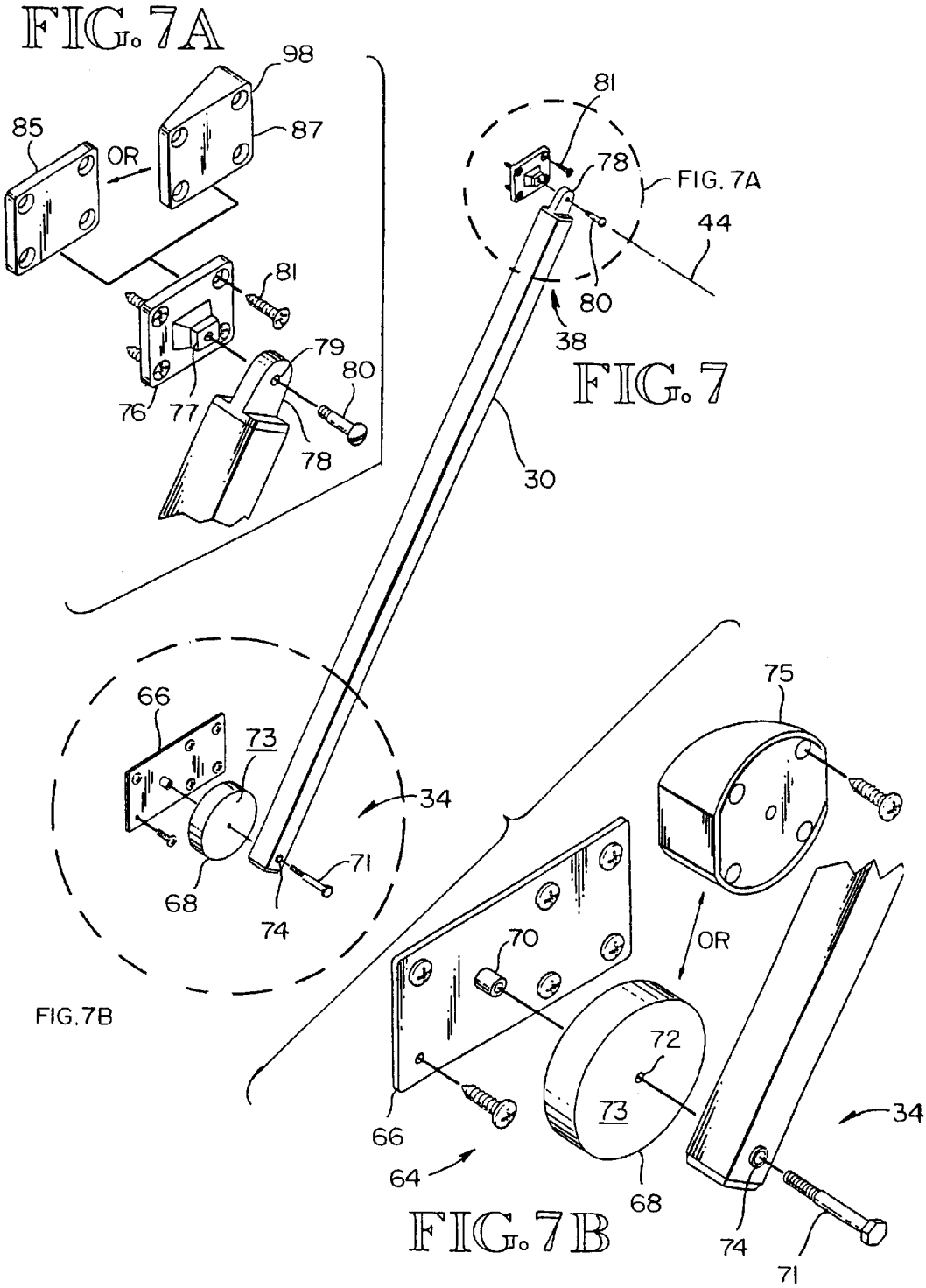
FIG. 7 is an exploded perspective view showing the components of a side arm pivotally attached to a side arm pivot assembly, with portions encircled by broken lines representing matter that is illustrated and enlarged in FIGS. 7A and 7B.
FIG. 7A is an exploded view illustrating the components of an upper end of a side arm for attaching the side arm to the spa cover.
FIG. 7B is an exploded view illustrating the components of a side arm pivot assembly disposed at the lower end of a side arm for attaching the side arm to the bottom side portion of a spa side.

More specifically, as illustrated in FIG. 7 the lower end 34 of side arm 30 is connected to the bottom side portion 36 of the spa 28 via a side arm pivot assembly 64. The side arm pivot assembly 64 includes a side pivot bracket 66 that is fastened to the spa 28 by a plurality of threaded fasteners such as common wood screws. Additionally a pivot wheel 68 is mounted to the side pivot bracket 66, and is secured in place by a threaded insert 70 that is fixed to the side pivot bracket 66 and projects outward therefrom. So that the pivot wheel 68 can fit closely against the side pivot bracket 66, a portion of the pivot wheel is countersunk (not illustrated) so that the same can be received over the threaded insert 70.

With the side arm pivot assembly 64 in place, a side arm 30 is pivotally attached thereto by a bolt 71 that extends through the lower end 34 of side arm 30, and similarly through a centrally disposed hole 72 located through the pivot wheel 68, the hole 72 being positioned to align with the threaded insert 70. In this way, the bolt 71 can threadedly engage the threaded insert 70 to support and maintain the side arm 30 in position. Further it should be noted that in the preferred embodiment, a bushing 74 is provided through the side arm 30 to reinforce the same, and to guide the bolt 71 therethrough.

The pivot wheel 68 is disposed to provide a substantially flat surface 73 against which the side arm 30 can bear and pivot. This arrangement helps to maintain the rigidity against transverse sway, thereby increasing lateral stability of the side arms 30–32. Accordingly, the flat surface 73 must be parallel to the direction that the side arm 30 extends. For most configurations of spas, the side pivot bracket 66 is mounted to a straight non-curving bottom side portion 36 as illustrated in FIG. 7. Accordingly, the pivot wheel 68, is constructed so that the surface that bears against side pivot bracket 66 (not illustrated) is parallel to surface 73. However, the shape of some spas require that the side pivot bracket 66 be attached thereto on a curved portion of surface. When this situation arises, a wedged shaped pivot wheel 75 must be substituted for pivot wheel 68. In this way, the wedge shaped pivot wheel 75 compensates for the curved surface so that the side arms 30–32 are maintained parallel to each other. It should be understood that when a wedged shaped pivot wheel 75 is employed, the need for a side pivot bracket is eliminated. In this situation, the wedged shaped pivot wheel 75 is secured directly to the spa 28.

Beyond this, each side arm 30–32 extends upward and is attached to the spa cover 26 such that the same is allowed to rotate. For this purpose, a side hinge 76 is fixed to the side edge 40 by a plurality of fasteners 81. In addition, a side hinge spacer 85, used in certain situations where additional space is required, is disposed between the side hinge 76 and the side edge 40. For spa configurations where the side hinge 76 falls on a curved surface, a side wedge 87 can be substituted for, or added to, the side hinge spacer 85 to compensate for the curvature thereby ensuring proper seating of the eye end 78. The side hinge 76 is provided as a rotational connection point between the spa cover 26 and the side arm 30. Specifically, a post 77 projects outward from the side hinge 76 for engagement with the eye end 78 disposed on the upper end 38 of side arm 30. The eye end 78 is formed and constructed to be securely received within a side arm. The eye end 78 includes a hole 79 through which a screw 80 is guided and fastened to the post 77 of side hinge 76. By forming this connection, the spa cover 26 is enabled to rotate about a cover rotation axis 44 while being supported by the side arm 30.

In the preferred embodiment, the side arm 30 extends upward at an angle of approximately 52 to 56 degrees. As will be discussed more fully below, this configuration causes the spa cover 26 to raise from the spa 28 substantially simultaneously when the spa cover 26 is pulled rearward. This action prevents interference between the spa 28 and the spa cover 26 when the same is moved to, or from, the second stowed position. It should be noted that the opposing side arm 32 is similarly attached such that it is a mirror image of side arm 30. With this construction, the side arms 30–32 are parallel.

Figure 5:
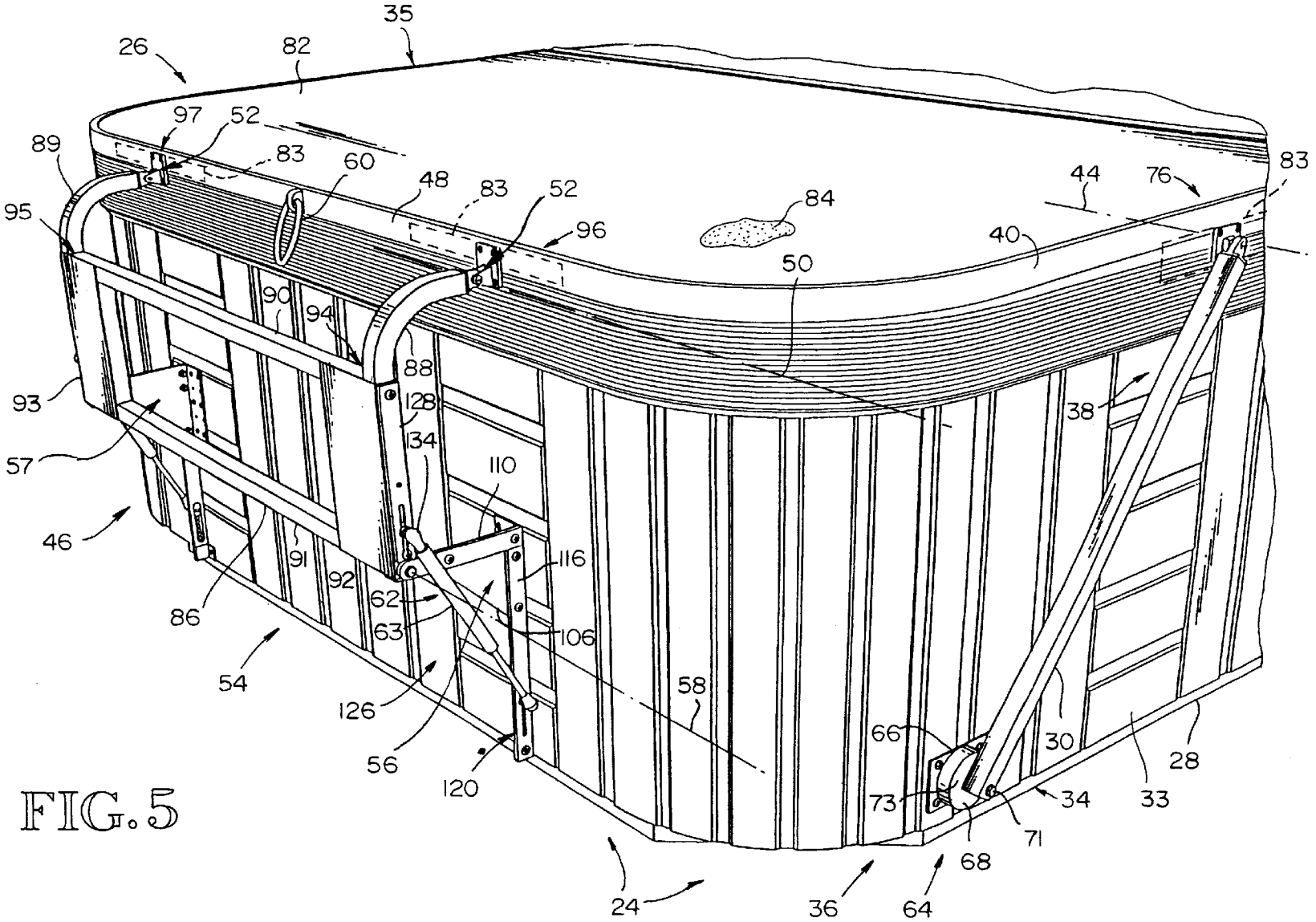
FIG. 5 is a fragmentary rear perspective view showing a cover cradle removal apparatus mounted to the back surface of a spa in accordance with the present invention, the cover cradle removal apparatus being operatively coupled to a spa cover for assisting the removal thereof.

Directing attention to FIG. 5, for connection of the side hinge 76 to the spa cover 26, aluminum cover channels 83 (illustrated by phantom lines) are embedded, and/or fixed to the side edge 40. The cover channels 83 are disposed such that the side hinge 76 is approximately 29 to 30 inches from the back hinges 96–97, i.e., from cover rotation axis 44 to cover pivot axis 50, which represents the optimal distance. Specifically, the cover channels 83 are secured to the spa cover 26 as disclosed in U.S. Pat. No. 4,857,374 issued Aug. 15, 1989 to Perry wherein this patent is hereby incorporated by reference.

For example a cover channel 83 having pre drilled holes to match the fastener pattern of the side hinge 76 are located inside the vinyl encasement 82, attached to the cover's core 84. In this way, the loads generated at the side hinge 76, by a side arm can be more evenly distributed to the core 84 of the spa cover 26.

Turning now to FIGS. 5–6 and 8–9 a back rack 46 is illustrated. The back rack 46 is operatively disposed between the spa cover 26 and the base bracket assemblies 56–57: the back rack 46 being pivotally connected to the spa cover 26 and to each opposing base bracket assembly 56–57. As noted above, the spa cover 26 pivots about a cover pivot axis 50 defined by connection joint(s) 52 disposed between the back rack 46 and the spa cover 26. Additionally, the back rack 46 pivots relative to the back surface 54 of the spa 28 via base bracket assemblies 56–57.

Figures 4A, 4B, 4C, 4D, 4E:
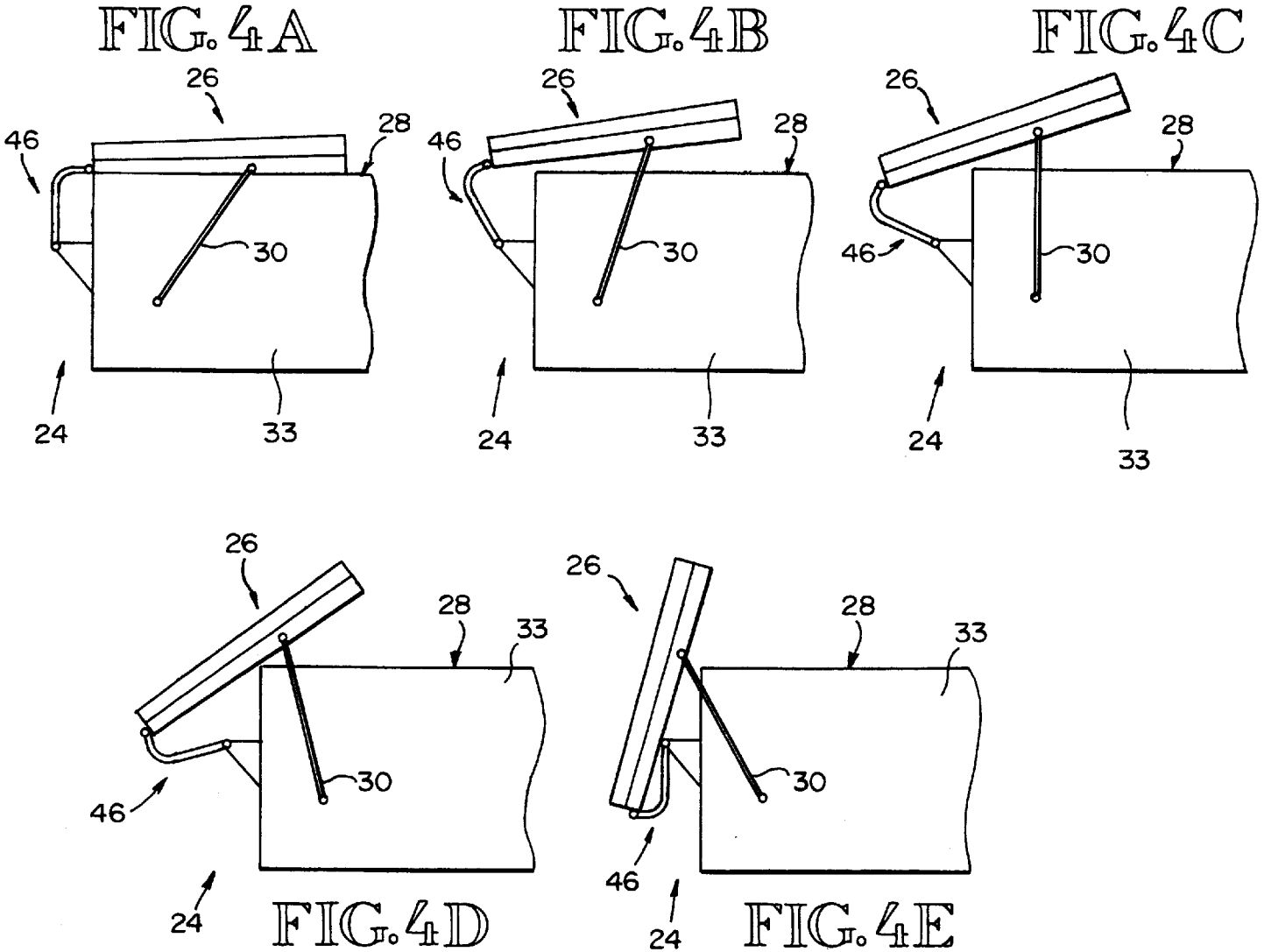

Specifically, a back rack 46 is provided to render increasing support to the spa cover 26 as the same shifts rearward and downward to a stowed position as best illustrated in FIG. 4E. A back rack 46 includes a symmetrically constructed planar back panel 86 configured to receive a pair of spaced back arms 88–89. The back arms 88–89 are so received at horizontally opposed ends of the back panel 86. A back panel 86 is constructed from a pair of spaced parallel tubular frame members 90–91 that are connected at the ends thereof to a pair of spaced panel ends 92–93. The panel ends 92–93 are fabricated from sheet metal: shaped and attached to the frame members 90–91 so as to form an open top end 94, i.e., a passage, through which the opposing spaced back arms 88–89 are received and secured. Moreover, the panel ends 92–93 are securably fixed to the frame members 90–91 to maintain a substantially square rigid planar structure, i.e., back panel 86. In the preferred embodiment, the majority of connected parts are joined using common threaded fasteners, however, other means of fastening, such as welds or rivets, could be employed.

Figure 8:
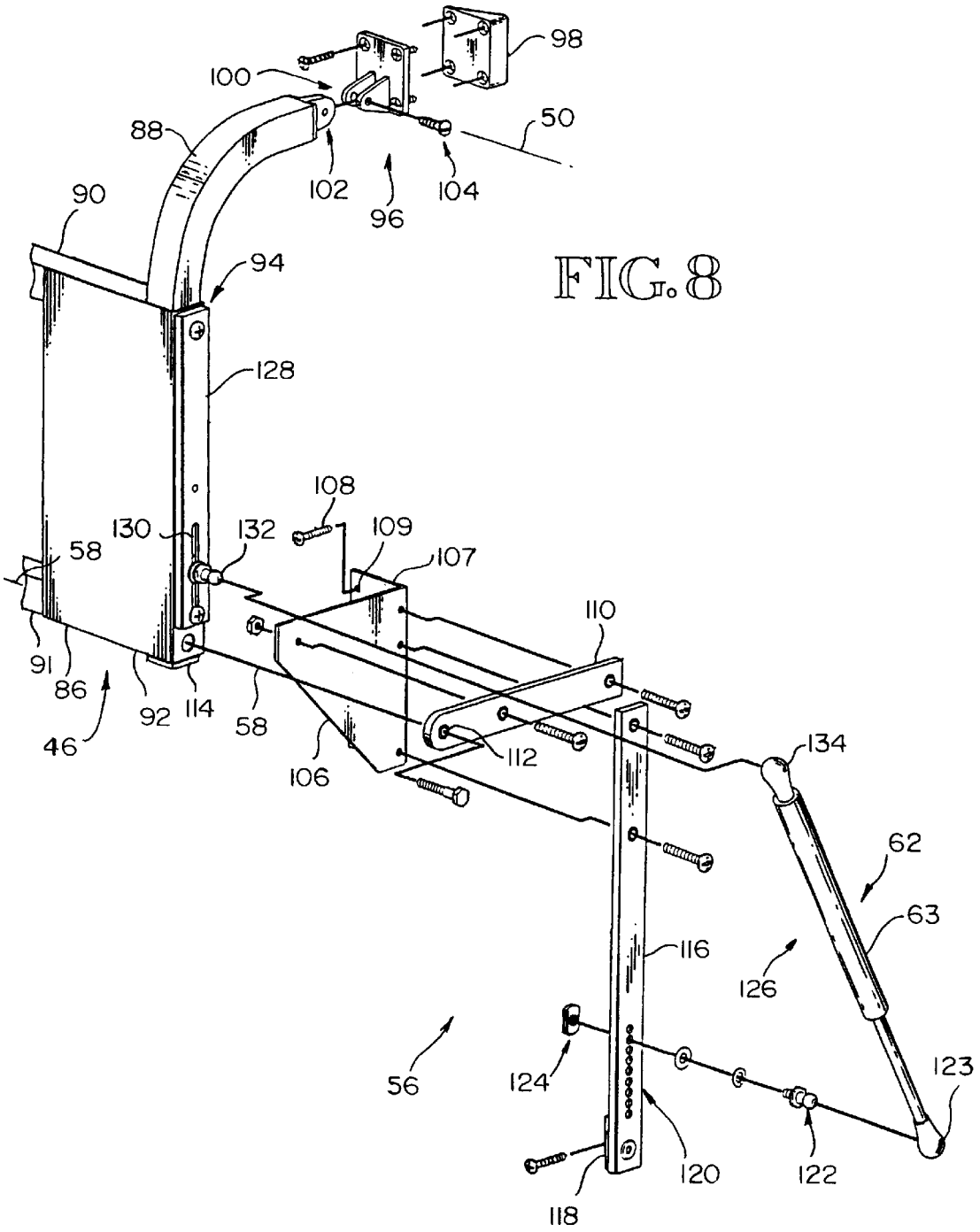
FIG. 8 is an exploded fragmentary perspective view showing the components of a back rack and base bracket assembly.
Figure 9:
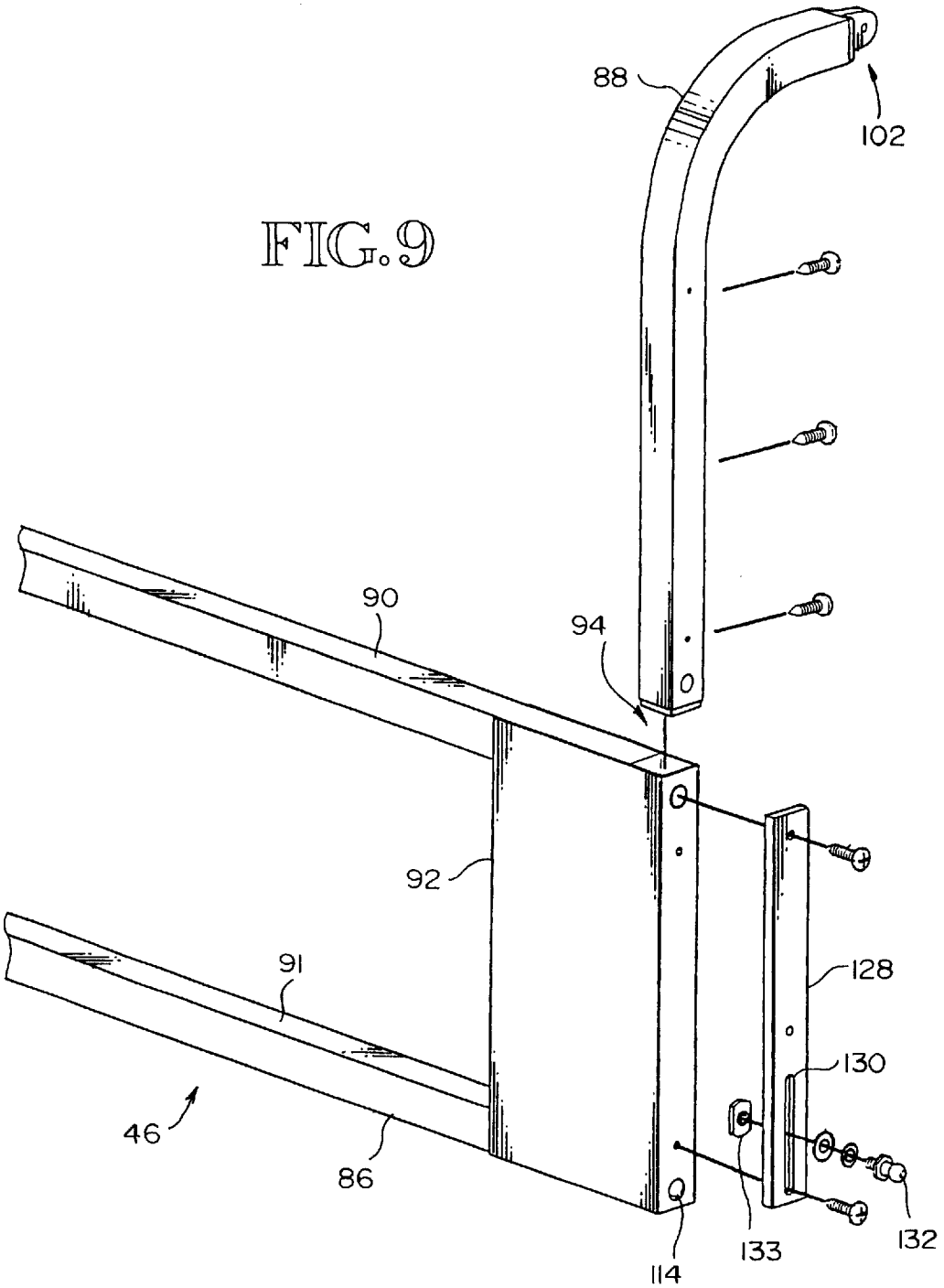
FIG. 9 is a exploded fragmentary perspective view showing the components of a back rack.

Turning now to FIGS. 5 and 8, it can be seen that back arms 88–89 are curved and extend from the back panel 86 to the spa cover 26. Similar to the side arms 30–32, the back arms 88–89 are pivotally connected to the spa cover 26. To facilitate this connection, a pair of back hinges 96–97 are provided and fixed to the rear edge 48 of the spa cover 26. Similar to the side hinges, the connection of the back hinges 96–97 to the spa cover 26 is facilitated by a cover channel 83 disposed inside the vinyl encasement 82 adjacent the core 84 as previously noted.

Each back hinge 96–97 is constructed to form a pair of parallel spaced dog ears 100 between which an eye end 102, of a back arm 88–89, is pivotally received and secured by a screw or bolt 104. Like eye end 78, eye end 102 is constructed to securely be received into a tubular member. Because the bolt 104 defines the pivot point of the spa cover 26 and the back rack 46, the bolt 104 is coaxial with the cover pivot axis 50. The eye end 102 is so secured by a bolt 104 that is guided through a commonly disposed and aligned hole. Accordingly, an eye end 102 is fixedly disposed on each respective end of the back arms 88-89. In addition, for those situations where a back hinge is connected to a curved surface (not illustrated) a rear hinge wedge 98 can be employed to compensate for the curvature and ensure that the connection of the eye end 102 is square to the back hinge 96 or 97.

As noted above, the back rack 46 is pivotally connected to a pair of horizontally spaced base bracket assemblies 56–57. It should be appreciated that the base bracket assemblies 56–57 are constructed so that the back panel pivot axis 58 is offset, i.e., set rearward from the spa 28. For this reason the back arms 88–89 are curved. In this way, the eye end 102 of the back arms 88-89 immediately lift upward as the spa cover 26 is pulled or moved in a rear ward direction. Thus, the spa cover 26 is substantially raised from the spa 28, by the back rack 46 in combination with the side arms 30–30, at the first movement of the spa cover 26 in a rearward direction.

Like the side arms 30–32, each base bracket assembly 56–57 is of like construction: each being the mirror image of the other. Considering now the components of the base bracket assemblies, only base bracket assembly 56 will be discussed: it will be assumed that the components of base bracket assembly 57 are substantially a mirror image thereof. Acting together, the base bracket assemblies 56–57 pivotally support the back rack 46 such that the same pivots about a back rack pivot axis 58. Accordingly, the base bracket assemblies are fixedly mounted to the back surface 54 so that loads imparted to the back rack 46 are transferred to the spa 28.

To provide pivotal support, base bracket assembly 56 comprises a plurality of interconnected components. Importantly, a base bracket 106 having a flange 107 is mounted to the back surface 54 by a plurality of threaded fasteners 108 disposed through flange holes 109 disposed through flange 107. It should be noted that in various spa configurations, the back surface 54 is curved. To compensate for this, a shim (not illustrated) can be placed between the flange 107 and the back surface 54. Additionally, the angle of the flange 107 to the base bracket 106 can be modified to compensate for the curved spa surface. Typically, the above noted angle ranges between 90 degrees and 102 degrees.

Secured to the base bracket 106 is a pivot bar 110 that extends horizontally past the base bracket 106 for pivotal engagement with the lower portion of the back rack 46. Specifically, a threaded fastener is guided through hole 112 into threaded insert 114. In this way, the back rack 46 is pivotally connected to the pivot bar 110.

Because the load imparted to the back rack 46 increases as the spa cover 26 is pulled rearward, a gas spring 63 is provided to resist a portion of the load. The gas spring 63 is operatively disposed between the base bracket assembly 56 and the back rack 46. To facilitate this connection, a lower gas spring bar 116 is vertically mounted from the base bracket 106. It should be noted that the lower portion of the lower gas spring bar 116 is connected to the back surface 54 by a flex brace 118 riveted to the lower gas spring bar 116 and fastened to the spa. The lower gas spring bar 116 includes a plurality of lower gas spring holes 120 through which a ball stud 122 is secured. The ball stud 122 is provided for engagement with a socket (not illustrated) located on the lower end of the gas spring 63. It should be noted that the ball stud 122 is secured through the lower gas spring holes 120 via a slot nut 124 disposed within a slot (not illustrated); the slot being countersunk into one side of the lower gas spring bar 116. Accordingly the ball stud 122 is received by socket head 123.

To receive the barrel end 126 of the gas spring 63, an upper gas spring bar 128 having a ball stud slot 130 is provided. The upper gas spring bar 128 is secured to panel end 92 of the back rack 46 as illustrated in FIG. 8. The ball stud slot 130 is disposed to receive therethrough a ball stud 132 secured to a slot nut 133. Like the lower gas spring bar 116, a portion of the upper gas spring bar 128 is countersunk (not illustrated) to receive the slot nut 133. With this configuration, the ball stud 132 can be properly positioned to receive the socket head 134 of barrel end 126. Accordingly, the gas spring 63 can assume an infinite number of positions thereby providing a wide range of adjustment for the amount of load it assumes to resist.

Figure 10:
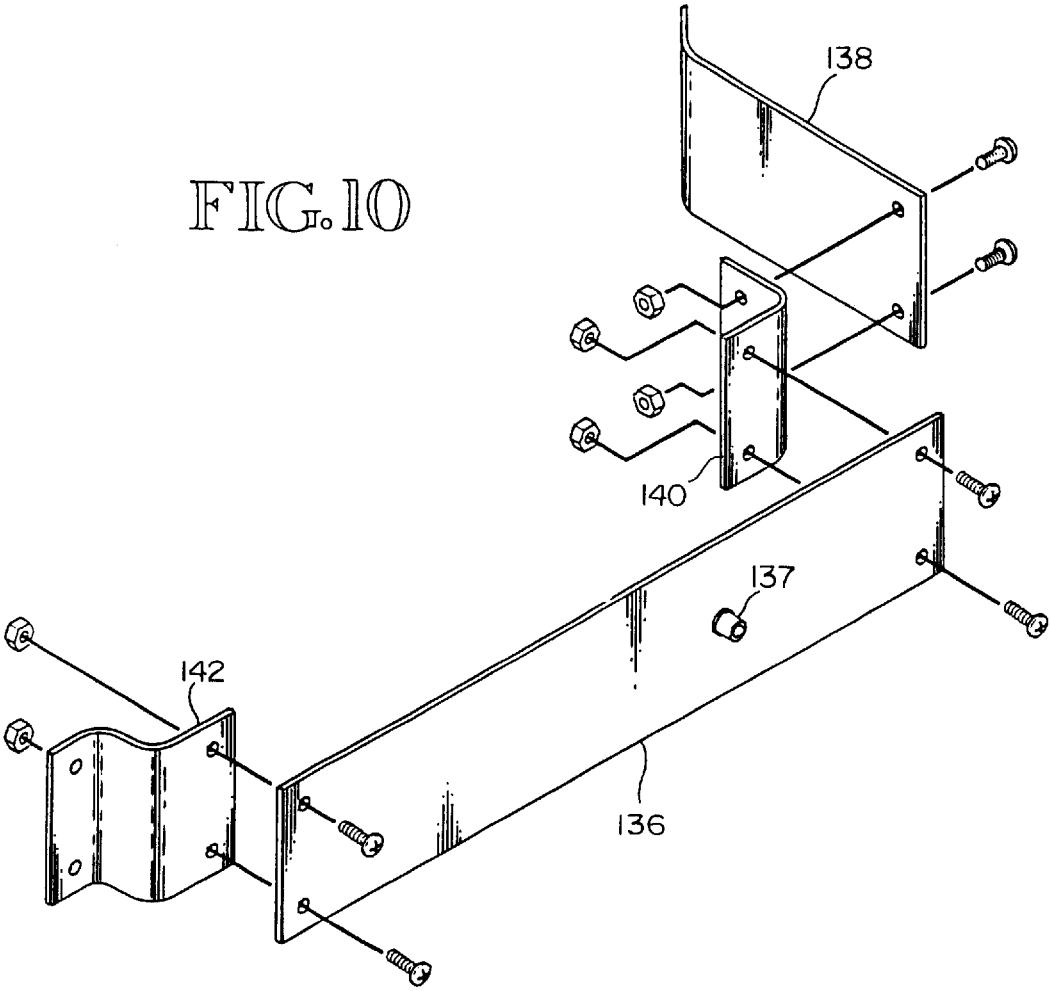
FIG. 10 is a perspective view of an alternate embodiment of a side arm pivot assembly for use with a spa having an irregular/curved bottom side portion or mounting surface.
Figure 11:
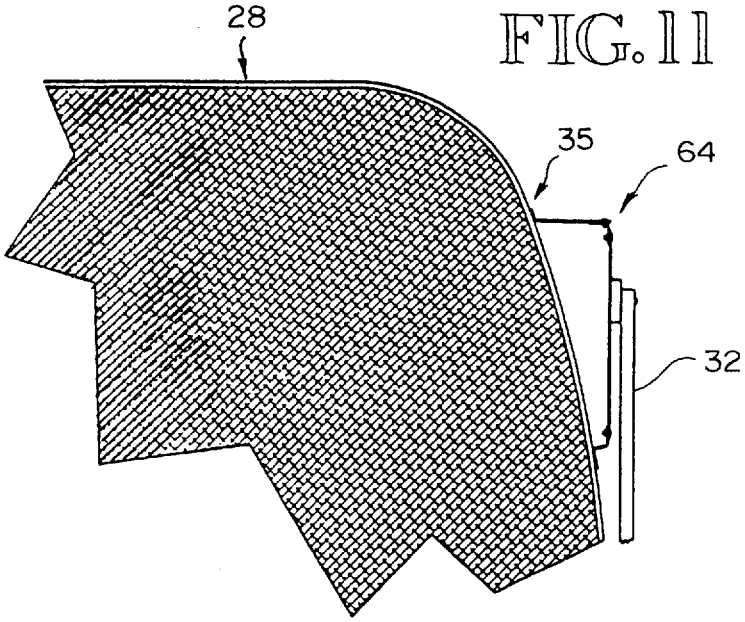
FIG. 11 is a plan view of an alternate embodiment side arm pivot assembly attached to a spa having an irregular/curved mounting surface.
Figure 12:
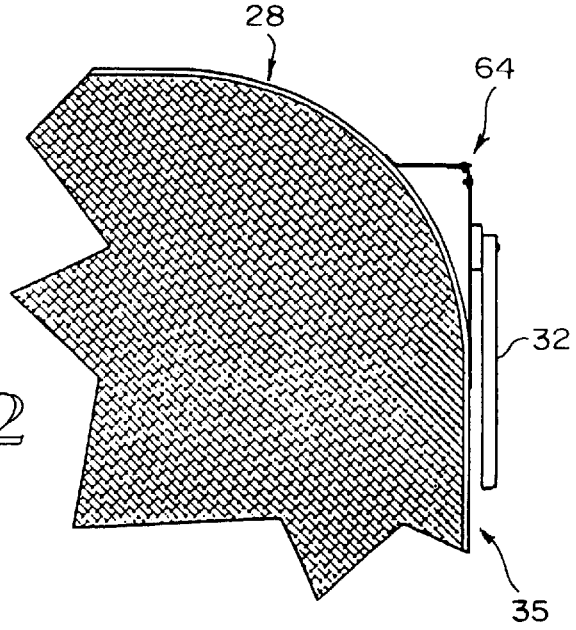
FIG. 12 is a plan view of an alternate embodiment side arm pivot assembly attached to a spa having an irregular/curved mounting surface.

Directing attention to FIGS. 10, 11 and 12 an alternate embodiment is illustrated. The alternate embodiment is provided so that side arms 30–32 can be adapted to mount to spas having extreme curved bases as best seen in FIGS. 11–12. For this purpose, side pivot bracket 136, having a threaded insert 137, is secured at one end thereof to a flanged bracket 138 via corner bracket 140. Likewise, the opposite end of the side pivot bracket 136 is secured to a front bracket 142. It should be noted that a front bracket 142 is optional depending on the severity of the curved spa surface. Accordingly, the side pivot bracket 136 is mounted to the spa 28.

Figure 13:
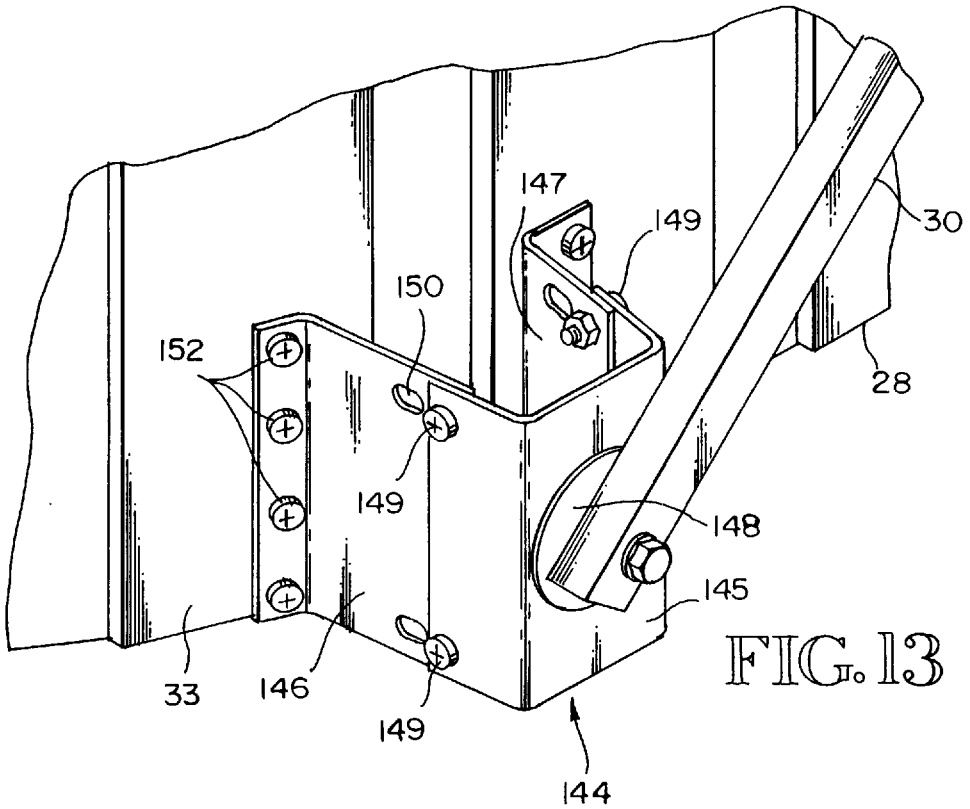
FIG. 13 is a perspective view of an alternate embodiment of a side arm pivot assembly for use with a spa having an irregular/curved bottom side portion or mounting surface.

Turning now to FIG. 13 an additional embodiment showing a side arm pivot assembly 144 is illustrated. This embodiment is provided to facilitate the connection of a side arm to a rounded portion of a spa side 33. Included therein is a side arm pivot bracket 145 disposed to rotatingly support side arm 30. To reduce friction between the side arm pivot assembly 144 and the side arm 30, a pivot disk 148 is disposed therebetween. Typically, a pivot disk 148 is constructed from a low friction material such as hard plastic. To facilitate the connection of the side arm pivot bracket 145 to the spa 28, extension legs 146–147 extend from the side arm pivot bracket 145 to the spa 28. For this purpose, a plurality of fasteners 149 are employed through a plurality of holes 150 as illustrated. For adjustment purposes, the holes in the extension legs can be slotted (not illustrated). Finally, the extension legs 146–147 are attached to the spa 28 by common wood screw type fasteners 152.

In operation, the cover cradle 24 transfers the spa cover 26, and the weight thereof, from the spa 28 rearward such that the spa cover 26 is supported substantially entirely by the back rack 46. This transfer is responsive to the user urging the spa cover 26 rearward such that the side arms pivot relative to the spa 28, and the back rack 46 pivots relative to the base bracket assemblies 56–57. Accordingly, the spa cover shifts rearward from a first horizontal covering position over the spa 28, to a second stowed position adjacent the back surface 54 of the spa 28. Importantly, the reverse of this procedure is followed to reposition the spa cover 26 over the spa 28.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

That which is claimed is:

1. A spa cover removal apparatus for assisting in the repositioning and removal of a spa cover from a spa/hot tub, the spa cover having a rear edge disposed between opposite side edges, and the spa having a back surface disposed between opposing spa sides which include a bottom side portion, the spa cover removal apparatus comprising:

a pair of elongate spaced apart side arms, each side arm being disposed adjacent a spa side of the spa wherein one end of each side arm is adapted to be pivotally connected to the bottom side portion of a spa side, and the opposing end is adapted to rotatingly engage a side edge of the spa cover such that the spa cover can rotate in relation to the side arms, the arrangement of each side arm being the mirror image of the other, wherein a horizontal cover rotation axis is defined by the axis of rotation of the spa cover relative to the side arms;

a back rack adapted to be pivotally coupled to the rear edge of the spa cover to enable the spa cover to pivot, relative to the back rack, about a horizontal cover pivot axis; and a base bracket assembly for pivotally connecting the back rack to the back surface of the spa, to enable the back rack to pivot, relative to the base bracket assembly, about a substantially horizontal back rack pivot axis such that as a rearwardly directed force is increasingly applied to the spa cover causing the same to move rearward, the side arms pivot relative to the spa, and the back rack pivots relative to the base bracket assembly, responsive to rearward movement of the spa cover wherein the spa cover shifts from a first horizontal covering position over the spa, to a second stowed position adjacent the back surface of the spa.

2. A spa cover removal apparatus as recited in claim 1 further comprising a biasing member operatively disposed between the base bracket assembly and the back rack, said biasing member adapted to provide increasing resistance against the pivoting action of the back rack as the back rack pivots about the back rack pivot axis to shift the spa cover to the second stowed position.

3. A spa cover removal apparatus as recited in claim 2 wherein the biasing member is a gas spring having one end coupled to the back rack and an opposing end coupled to the base bracket assembly.

4. A spa cover removal apparatus as recited in claim 3 wherein the biasing force of the gas spring is infinitely adjustable according to the position of the gas spring in relation to the back rack when the spa cover removal apparatus is in the horizontal covering position.

5. A spa cover removal apparatus as recited in claim 1 wherein as the spa cover shifts from the first horizontal covering position over the spa, to the second stowed position, the spa cover rotates about the cover rotation axis as the cover rotation axis translates rearward.

6. A spa cover removal apparatus as recited in claim 5 wherein the spa cover pivots about the cover pivot axis as the cover pivot axis translates rearward when the spa cover shifts from the first horizontal covering position over the spa, to the second stowed position.

7. A spa cover removal apparatus as recited in claim 1 wherein as the spa cover shifts from the first horizontal covering position over the spa, to the second stowed position, the spa cover pivots about the cover pivot axis as the cover pivot axis translates rearward.

8. A spa cover removal apparatus as recited in claim 1 wherein back panel pivot axis is disposed rearward of the back surface when spa cover is in the first horizontal covering position.

9. A spa cover removal apparatus as recited in claim 1 wherein the weight of the spa cover increasingly shifts to back rack as the spa cover shifts from the first horizontal covering position over the spa, to the second stowed position adjacent the back surface of the spa.

10. A spa cover removal apparatus as recited in claim 1 wherein the side arms are parallel and extend upward, in relation to horizontal, at an angle between 52 and 56 from the bottom side portion of a spa side to the side edge of the spa cover.

11. A spa cover removal apparatus as recited in claim 1 wherein as the spa cover initially shifts from the first horizontal covering position over the spa, to the second stowed position, the entire spa cover moves upward as well as rearward.

12. A spa cover removal apparatus for assisting in the repositioning and removal of a spa cover from a spa/hot tub, the spa cover having a rear edge disposed between opposite side edges, and the spa having a back surface disposed between opposing spa sides which include a bottom side portion, the spa cover removal apparatus comprising:

a pair of elongate spaced apart side arms, each side arm being disposed adjacent a spa side of the spa wherein one end of each side arm is adapted to be pivotally connected to the bottom side portion of a spa side, and the opposing end is adapted to rotatingly engage a side edge of the spa cover such that the spa cover can rotate in relation to the side arms, the arrangement of each side arm being the mirror image of the other, wherein a horizontal cover rotation axis is defined by the axis of rotation of the spa cover relative to the side arms;

a back rack adopted to be pivotally coupled to the rear edge of the spa cover to enable the spa cover to pivot, relative to the back rack, about a horizontal cover pivot axis;

a base bracket assembly for pivotally connecting the back rack to the back surface of the spa, to enable the back rack to pivot, relative to the base bracket assembly, about a substantially horizontal back rack pivot axis such that as the spa cover is urged rearward, the side arms pivot relative to the spa, and the back rack pivots relative to the base bracket assembly, responsive to rearward movement of the spa cover wherein the spa cover shifts from a first horizontal covering position over the spa, to a second stowed position adjacent the back surface of the spa; and a gas spring operatively disposed between the base bracket assembly and the back rack, the gas spring adapted to provide increasing resistance against the pivoting action of the back rack as the back rack pivots about the back rack pivot axis to shift the spa cover to the second stowed position.

13. A spa cover removal apparatus as recited in claim 12 wherein the biasing force of the gas spring is infinitely adjustable according to the position of the gas spring in relation to the back rack when the spa cover removal apparatus is in the horizontal covering position.

14. A spa cover removal apparatus as recited in claim 12 wherein as the spa cover shifts from the first horizontal covering position over the spa, to the second stowed position, the spa cover rotates about the cover rotation axis as the cover rotation axis translates rearward.

15. A spa cover removal apparatus as recited in claim 12 wherein back panel pivot axis is disposed rearward of the back surface when spa cover is in the first horizontal covering position.

16. A spa cover removal apparatus as recited in claim 12 wherein the side arms are parallel and extend upward, in relation to horizontal, at an angle between 52 and 56 from the bottom side portion of a spa side to the side edge of the spa cover.

17. A spa cover removal apparatus as recited in claim 12 wherein as the spa cover initially shifts from the first horizontal covering position over the spa, to the second stowed position, the entire spa cover moves upward as well as rearward.

18. A method of employing a spa cover removal apparatus for assisting in the repositioning and removal of a spa cover from a spa/hot tub, the spa cover having a rear edge disposed between opposite side edges, and the spa having a back surface disposed between opposing spa sides which include a bottom side portion, the method comprising the steps:

providing a pair of elongate spaced apart side arms, each side arm being disposed adjacent a spa side of the spa wherein one end of each side arm is pivotally connected to the bottom side portion of a spa side, and the opposing end rotatingly engages a side edge of the spa cover such that the spa cover can rotate in relation to the side arms, the arrangement of each side arm being the mirror image of the other, wherein a horizontal cover rotation axis is defined by the axis of rotation of the spa cover relative to the side arms;

pivotally coupling a back rack to the rear edge of the spa cover to enable the spa cover to pivot, relative to the back rack, about a horizontal cover pivot axis; and providing a base bracket assembly for pivotally supporting the back rack from the back surface of the spa, to enable the back rack to pivot, relative to the base bracket assembly, about a substantially horizontal back rack pivot axis; and urging the spa cover rearward such that the side arms pivot relative to the spa, and the back rack pivots relative to the base bracket assembly, responsive to rearward movement of the spa cover wherein the spa cover shifts from a first horizontal covering position over the spa, to a second stowed position adjacent the back surface of the spa.

19. A method of employing a spa cover removal apparatus as recited in claim 18 further comprising the step of providing a biasing member operatively disposed between the base bracket assembly and the back rack, said biasing member adapted to provide increasing resistance against the pivoting action of the back rack as the back rack pivots about the back rack pivot axis to shift the spa cover to the second stowed position.

20. A method of employing a spa cover removal apparatus as recited in claim 18 wherein the side arms are parallel and extend upward, in relation to horizontal, at an angle between 52 and 56 from the bottom side portion of a spa side to the side edge of the spa cover.

* * * * *